United States Patent [19]

Nagasaka et al.

[11] Patent Number: 4,913,495

[45] Date of Patent: Apr. 3, 1990

[54] SEAT

[75] Inventors: Youetsu Nagasaka; Akihiko Yatsushiro, both of Fujisawa, Japan

[73] Assignee: Shiroki Corporation, Fujisawa, Japan

[21] Appl. No.: 384,539

[22] Filed: Jul. 25, 1989

[30] Foreign Application Priority Data

Feb. 23, 1989 [JP] Japan ..... 64-21015[U]

[51] Int. Cl.[4] ..... A47C 3/00

[52] U.S. Cl. ..... 297/284; 297/312; 297/460

[58] Field of Search ..... 297/284, 312, 460

[56] References Cited

U.S. PATENT DOCUMENTS

| | | | |
|---|---|---|---|
| 4,148,522 | 4/1979 | Sakurada et al. | 297/284 |
| 4,295,681 | 10/1981 | Gregory | 297/284 |
| 4,296,965 | 10/1981 | Sakurada et al. | 297/284 |
| 4,693,513 | 9/1987 | Heath | 297/284 |
| 4,832,400 | 5/1989 | Aoki et al. | 297/284 |

*Primary Examiner*—James T. McCall
*Attorney, Agent, or Firm*—Schwartz & Weinrieb

[57] ABSTRACT

A seat for an automobile or the like includes a seat cushion; a seat back connected to the seat cushion, a space being formed within a lower portion of the seat back; a rod which is pivotably interposed between opposed side frames of the seat back and to one end of which a link plate is secured to an; a hip support secured intermedate portion of the rod and disposed within the space provided within the seat back; an operation handle provided upon one of the side frames; a pinion to which the rotation of the operation handle is transmitted by means of a brake mechanism; and a driven gear pivotably disposed upon onthe same axis as that of the rod and upon the aforenoted side frame for meshing engagement with the pinion, a pivoting end portion thereof being connected to a pivoting end portion of the link plate.

7 Claims, 6 Drawing Sheets

SEAT

FIELD OF THE INVENTION

The present invention relates to a seat for an automobile or the like and, more particularly, to a seat having a hip support for supporting the hip (the lumbar vertebrae L3 to L5) of an occupant of a vehicle.

BACKGROUND OF THE INVENTION

Seats of this type are disclosed in Japanese Utility Model Laid-Open Nos. 174462/1986 and 101850/1984.

The former Japanese Utility Model Laid-Open No. 174462/1986 discloses an arrangement in which a space is provided within a lower portion of a seat back, a hip support being accommodated within the space in such a manner as to be capable of being moved forwardly with its lower portion serving as a fulcrum, and when an occupant assumes a seated position in which his hip is moved forwardly, the hip support is moved forwardly so as to project away from the front surface of the seat back, thereby allowing the occupant's hip to be supported by means of this projecting portion. With this arrangement, when the occupant feels that the support of this hip is insufficient, it is necessary for him to rise up and seat himself again after moving the hip support to another position.

In the latter Japanese Utility Model Laid-Open No. 101850/1984, an arrangement is disclosed in which a space is provided within a lower portion of a seat back, a hip support being disposed within the space in such a manner as to be pivotable back and forth with an upper portion thereof serving as a fulcrum, and a seat plate is connected to a lower portion of this hip support by means of a hinge in such a manner as to be movable back and forth upon a seat cushion. With this arrangement, the occupant is seated upon the seat cushion through means of the seat plate. Accordingly, when the occupant feels that the support of his hip is insufficient, it is necessary for the occupant to rise up, move the hip support forwardly by pulling the seat plate in the forward direction, and then be seated again.

Thus, with the above-described two examples of the prior art, a drawback is encountered in that the occupant cannot adjust the position of the hip support while being seated.

OBJECTS OF THE INVENTION

Accordingly, an object of the present invention is to provide a seat which allows an occupant of a vehicle to adjust the position of a hip support while being seated, thereby overcoming the above-described drawback of the prior art.

Another object of the present invention is to provide a seat which allows stepless adjustment of the position of a hip support.

SUMMARY OF THE INVENTION

To these ends, in accordance with the present invention, there is provided a seat comprising a seat cushion; a seat back connected to the seat cushion, a space being formed within a lower portion thereof; a rod which is rotatably disposed between opposed side frames of the seat back and to one end of which a link plate is secured; a hip support secured intermediate the rod and disposed within the space provided within the seat back; an operation handle provided upon either one of the side frames; a pinion to which the rotation of the operation handle is transmitted by means of a brake mechanism; and a driven gear rotatably disposed upon on the same axis as that of the rod and upon the same side frame side for meshing engagement with the pinion, a rotating end portion thereof being connected to a rotating end portion of the link plate.

BRIEF DESCRIPTION OF THE DRAWINGS

Various other objects, features and advantges of the present invention will become more apparent from the following detailed description of the invention when read in conjunction with the accompanying drawings, in which like reference characters designate like or corresponding parts throughout the several views, and wherein.

DESCRIPTION OF THE PREFERRED EMBODIMENTS

Figure 1:
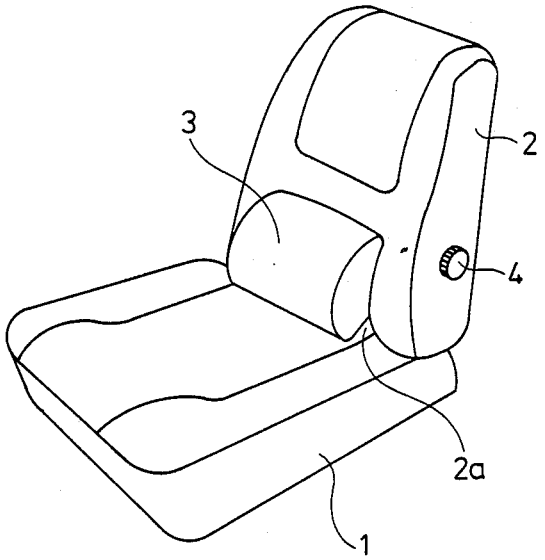
FIG. 1 is a perspective view of an overall arrangement of a seat constructed in accordance with an embodiment of the present invention.

Referring now to FIG. 1, a description will be given of an overall arrangement of a seat constructed in accordance with an embodiment of the present invention. A space 2*a* is formed within a lower portion of a seat back 2 which is connected to a seat cushion 1, a hip support 3 being disposed within this space 2*a*. The position of the hip support 3 is adjustable by means of an operation handle or rotatable knob 4.

Figure 2:
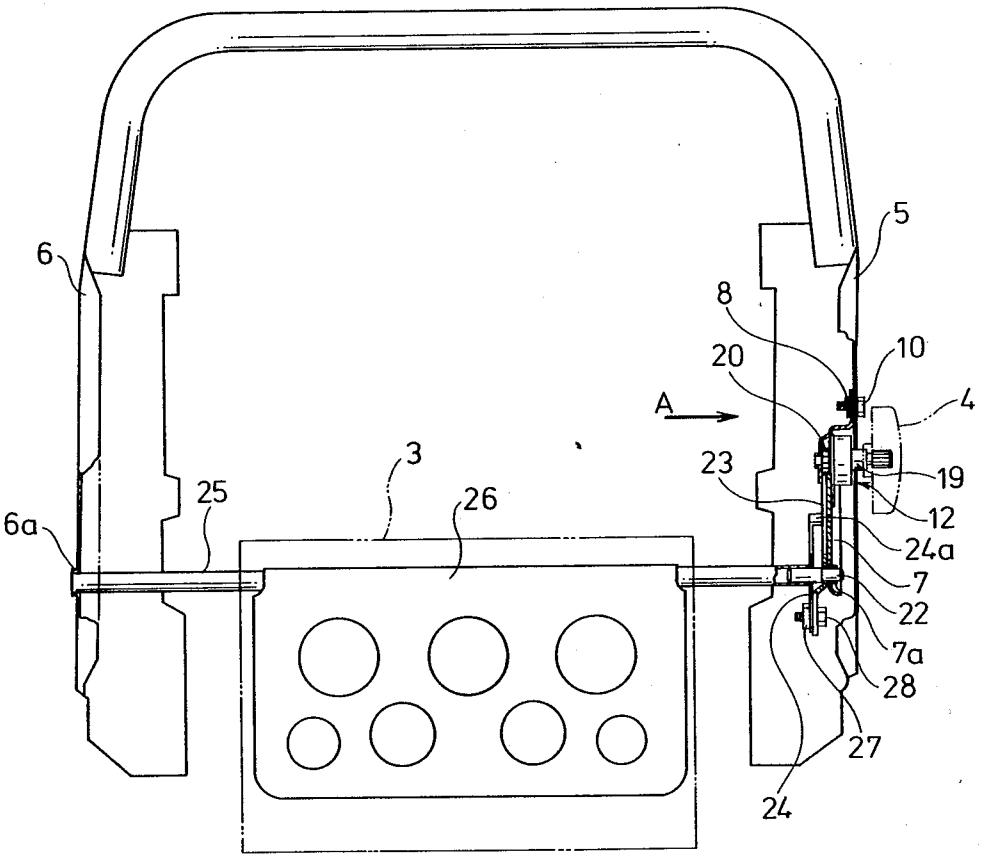
FIG. 2 is a partially cut-away front elevational view of the seat of FIG. 1 illustrating an essential portion of FIG. 1.
Figure 3:
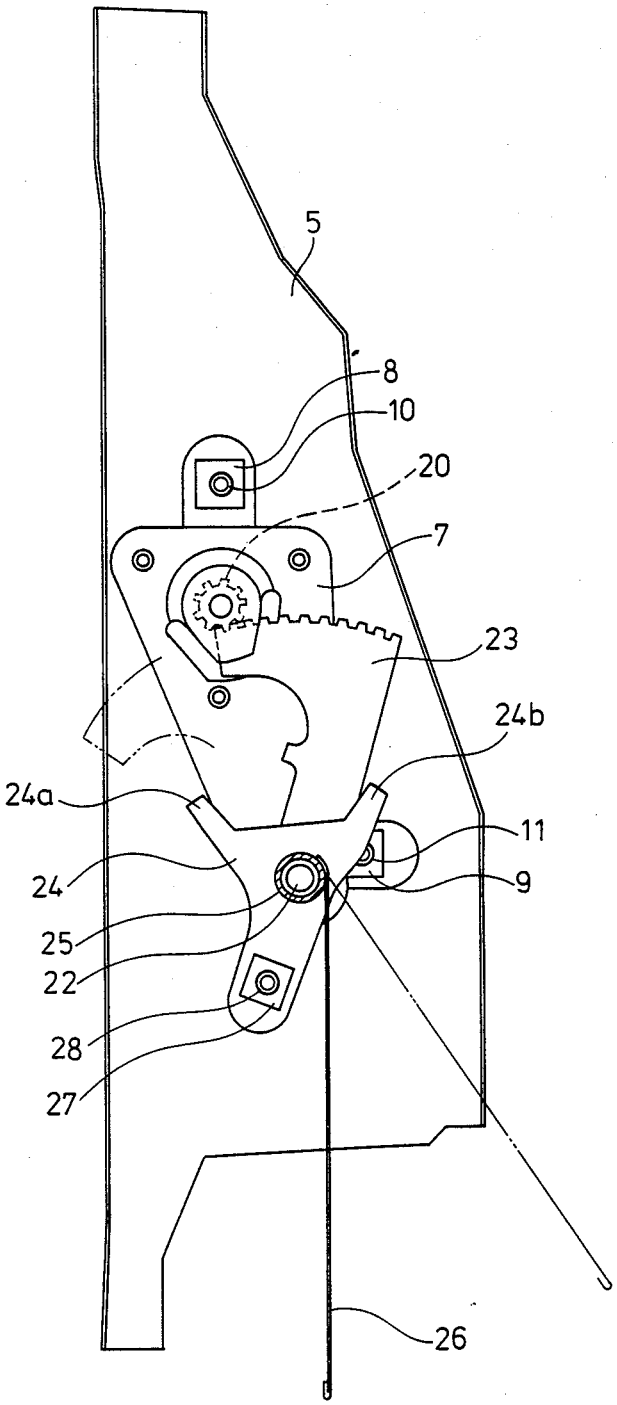
FIG. 3 is a view taken in the direction of the arrow A shown in FIG. 2.
Figure 4:
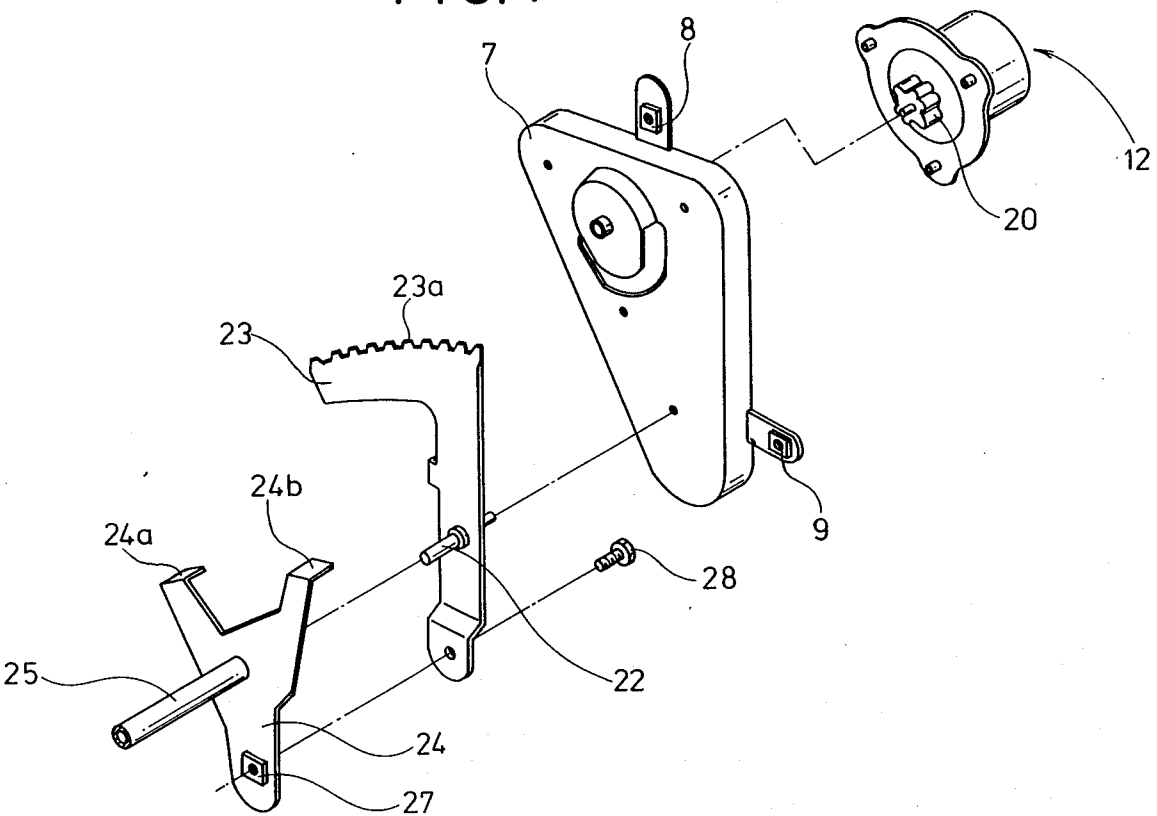
FIG. 4 is an exploded perspective view illustrating an essential portion of the support movement mechanism or system shown in FIG. 3.

Referring now to FIGS. 2–4, a description will be given of the hip support adjusting mechanism. Side frames 5, 6 are respectively provided upon opposite side portions of the seat back 2. A baseplate 7 is attached to one side frame 5. The attachment of the baseplate 7 is effected by causing bolts 10, 11 to threadingly engage with weld nuts 8, 9 welded onto the baseplate 7, respectively, in such a manner as to clamp the same to the side frame 5. A brake mechanism 12 is attached to the baseplate 7.

Figure 5:
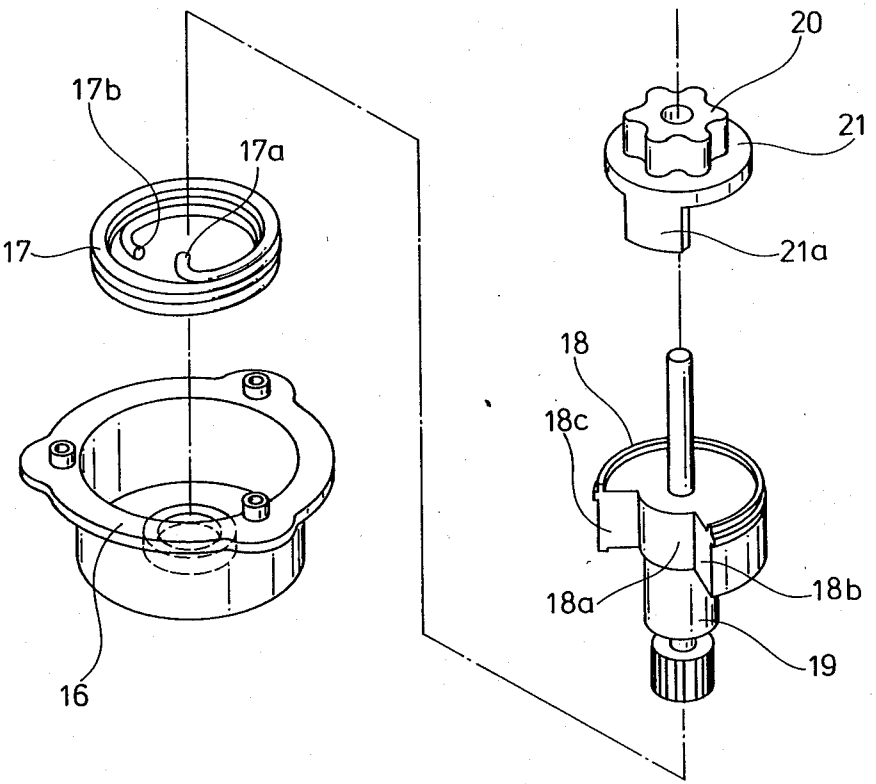
FIG. 5 is an exploded perspective view illustrating a brake mechanism shown in FIG. 2.

A description will now be given of the brake mechanism 12 with reference being made to FIGS. 5–7. A torsion spring 17 is disposed inside a brake housing 16 which is secured to the baseplate 7, in such a manner as to be brought into pressure contact with an inner wall of the brake housing 16. A core 18 provided with a notch 18*a* is rotatably inserted inside the torsion spring 17. In addition, a handle shaft 19 upon which the operation handle or rotary knob 4 is mounted is secured integrally secured to core 18. Furthrmore, a pawl portion 21*a* of a stopper plate 21 which is integrally formed with a pinion 20 is inserted within the space defined by means of notch 18*a* of the core 18 so as to be interposed between hook portions 17*a*, 17*b* of the torsion spring 17, and thereby be rotatable about the axis of the handle shaft 19.

Figure 6:
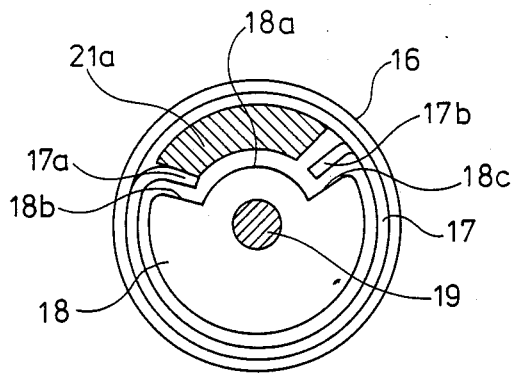
FIGS. 6 and 7 are diagrams illustrating the operation of the brake mechanism shown in FIG. 5.
Figure 7:
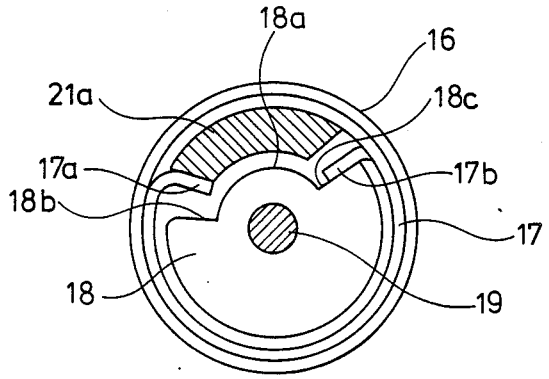

Accordingly, when a rotational force is applied from the pinion 20 side, the pawl portion 21*a* is brought into contact with one of the hook portions 17*a* or 17*b* of the torsion spring 17 and presses the same, as shown in FIG. 6, so as to radially expand the outside diameter of the torsion spring 17. For this reason, the pressure-contacting force acting between the torsion spring 17 and the brake housing 16 increases, with the result that the hook portions 17*a*, 17*b* do not move, thereby preventing the rotation of the pinion 20. Conversely, when an operting force is applied from the operation handle 4 (handle shaft 19) side, since the particular hook portion 17*a* or 17*b* of the torsion spring 17 is subjected, by means of a side end portion 18*b* or 18*c* of the core 18, to a force acting in the direction of contracting the outside diameter of the torsion spring 17, as shown in FIG. 7, the pressure-contacting force acting between the torsion spring 17 and the brake housing 16 decreases. This permits rotation of the handle shaft 19 to occur, and the torsion spring 17 also rotates as a result of being pushed by means of the handle shaft 19 and core 18, with the result that the pawl portion 21*a* rotates by as a result of being engaged by means of the particular hook portion 17*a* or 17*b* of the torsion spring 17. Hence, the pinion 20 also rotates.

Referring back to FIGS. 2–4, a bore 7*a* is provided within a lower portion of the baseplate 7 by means of a burring operation. A small-diameter portion of a stepped shaft 22 is rotatably disposed within this bore 7*a*. A driven sector gear 23 is secured to this small-diameter portion of the stepped shaft 22 and meshes with the pinion 20.

A link plate 24 is loosely disposed upon a large-diameter portion of the stepped shaft 22, and a pair of stopper arms 24*a*, 24*b* which are respectively capable of abutting against a side surface of the bseplate 7 are formd at one pivotable end portion of the link plate 24. A rod 25 is rotatably interposed between the side frames 5, 6. More particularly, one end of the rod 25 is loosely engaged with the large-diameter portion of the stepped shaft 22, while the other end thereof is loosely disposed within a bore 6*a* provided within the side frame 6 by means of a burring operation. The end surface of rod 25 which is disposed toward side frame 5 is secured to the link plate 24. In addition, an intermediate portion of the rod 25 is disposed within or traverses the space 2*a* provided within the seat back 2, a support plate 26 constituting a core portion of the hip support 3 being secured to this intermediate portion of rod 25.

A weld nut 27 is secured to the other pivotable end portion of the link plate 24. This pivotable end portion of the link plate 24 and the pivotable end portion of the driven gear 23 are connected to each other by means of a bolt 28 which is threadingly engaged with the weld nut 27 in such a manner as to clamp the driven gear 23 therebetween.

The operation of the above-described arrangement will now be described. FIGS. 2 and 3 illustrate a state in which the stopper arm 24*a* of the link plate 24 abuts the side surface of the baseplate 7, and the hip support 3 is accommodated within the innermost portion of the space 2*a* of the seat back 2. In this state, if the operation handle 4 is rotated so as to cause the pinion 20 to rotate clockwise, as viewed in FIG. 3, by means of the brake mechanism 12, the driven gear 23 meshing with the pinion 20 rotates counterclockwise, as viewed in FIG. 3. In conjunction with the rotation of the driven gear 23, the line plate 24 with its pivotable end portion connected to the driven gear 23 also rotates counteclockwise, as viewed in FIG. 3, about the stepped shaft 22. As the link plate 24 pivots, the rod 25 secured to the link plate 24 also pivots in the counterclockwise direction, as viewed in FIG. 3, which, in turn, causes the support plate 26 to pivotably move in the direction of being projected from the seat back 2, thereby causing the hip support 3 to project forwardly with respect to the space 2*a* of the seat back 2. This moement continues until the stopper arm 24*b* of the link plate 24 is brought into contact with the opposite side surface of the baseplate 7 at which the driven gear 23 and the support plate 26 are disposed at the position indicated by means of the two-dotted chain line shown in FIG. 3. It goes without saying that if the operaton handle 4 is rotated in the reverse direction, the hip support 3 returns to its initial position within the space 2*a* of the seat back 2. The particular position to which the hip support 3 is thus adjusted is maintained by virtue of the action of the above-described brake mechanism 12 unless the operation handle 4 is operated further.

In accordance with the above-described arrangement, the occupant even while disposed in a seated state is capable of adjusting the position of the hip support 3 by oprating the operation handle 4, and since that adjustment can be effected steplessly, it is possible to obtain support of the hips to any desired degree.

Although in the above-described embodiment the stopper arms 24*a*, 24*b* are provided upon the link plate 24, the stopper arms 24*a*, 24*b* may be provided upon the driven gear 23. In addition, it is possible to use a stepless shaft instead of the stepped shaft 22. Furthermore, welding or similar methods may be used as the method of connecting the pivoting end portion of the link plate 24 to the pivoting end portion of the driven gear 23.

It should be noted that the present invention is not confined to the above-described embodiments, and various modifications are possible without departing from the spirit of the invention which is defined solely by the accompanying claims.

What is claimed is:

1. A seat comprising:

a seat cushion;

a seat back connected to said seat cushion, wherein a space is formed within a lower portion of said seat back;

a rod rotatably interposed between opposed side frames of said seat back and to one end of which a link plate is secured;

a hip support secured upon an intermediate portion of said rod and disposed within said space provided within said seat back;

an operation handle provided upon one of said side frames;

a pinion to which rotation of said operation handle is transmitted by means of a brake mechanism; and a driven gear rotatably disposed upon the same axis as that of said rod upon said one side frame side for meshing engagement with said pinion, a rotating end portion of said driven gear being connected to a rotating end portion of said link plate.

2. A seat according to claim 1, wherein said brake mechanism is provided on one side frame by means of a baseplate.

3. A seat according to claim 1, wherein said brake mechanism comprises:

a brake housing attached to said baseplate;

a torsion spring disposed inside said brake housing in such a manner as to be brought into pressure contact with an inner wall of said brake housing;

a core secured integrally to a handle shaft on which said operation handle is mounted, said core being provided with a notch and being rotatably inserted inside said torsion spring;

a stopper plate formed integrally with said pinion and having a claw portion rotatably inserted within the space of said notch of said core between hook portions of said torsion spring in such a manner as to be rotatable about said handle shaft.

4. A seat according to claim 2, wherein:

a pair of stopper arms, for abutting against side surfaces of said baseplate, are provided upon said rotating end of said link plate so as to restrict the range of movement of said link plate.

5. A seat as set forth in claim 3, wherein:

said brake mechanism is a one-way type brake mechanism which permits rotation of said operation handle, said pinion, and said driven gear from a core side of said brake mechanism, but prevents rotation of said operation handle, said pinion, and said driven gear from a pinion side of said brake mechanism.

6. A seat as set forth in claim 1, wherein:

said driven gear comprises a sector gear.

7. A seat as set forth in claim 1, wherein:

said operation handle is disposed at a position which is external to a side portion of said seat back of said seat.

* * * * *